US005601327A

United States Patent [19]

Cho

[11] Patent Number: 5,601,327

[45] Date of Patent: Feb. 11, 1997

[54] DETACHABLE ADD-ON TOTE-BAG HANDLE-SHEATH

[76] Inventor: Kenneth C. Cho, 2572 Ukiah St., Port Hueneme, Calif. 93041

[21] Appl. No.: 509,548

[22] Filed: Jul. 31, 1995

[51] Int. Cl.[6] ..... A45C 13/26; B65D 33/06

[52] U.S. Cl. ..... 294/171; 294/137

[58] Field of Search ..... 294/137, 170, 294/171; D9/434; 16/114 R, DIG. 12; 383/6, 13, 25, 29

[56] References Cited

U.S. PATENT DOCUMENTS

| | | | |
|---|---|---|---|
| D. 328,187 | 7/1992 | Saurette | 294/171 |
| 1,781,583 | 11/1930 | Hodgson | 294/171 |
| 2,448,894 | 9/1948 | Laus | 294/171 |
| 3,635,382 | 1/1972 | Wilson | 294/171 |
| 4,902,060 | 2/1990 | Nobakht | 294/171 |

FOREIGN PATENT DOCUMENTS

| | | | |
|---|---|---|---|
| 88/06128 | 8/1988 | WIPO | 294/171 |

*Primary Examiner*—Dean Kramer
*Attorney, Agent, or Firm*—J. E. McTaggart

[57] ABSTRACT

For hand comfort in carrying items with handles such as tote bags, plastic bag with handles formed as openings, paper shopping bag with attached round cord handles, wire baskets, coat hangers and the like, an inexpensive add-on handle-sheath is formed in one embodiment from flexible plastic in an elongated extrudable shape of suitable length having a transverse cross-sectional shape defining an upwardly-facing V-shaped entry channel with pair of guide-walls converging downwardly to a narrowed throat leading to a wider conduit region in a bottom portion of the add-on handle for holding a pair of bag handles. The add-on handle-sheath is easily fitted to a tote bag by directing the two bag handles downwardly in the entry channel, through the throat and into the conduit region, where they become effectively but removably captivated in the add-on handle-sheath. Disclosed are a number of alternative extrudable cross-sectional configurations in which the invention can be made and practiced in different materials, and embodiments are shown for use with one or more wire handles of items such as wire baskets and coat hangers.

8 Claims, 4 Drawing Sheets

DETACHABLE ADD-ON TOTE-BAG HANDLE-SHEATH

FIELD OF THE INVENTION

The present invention relates to the field of hand-carried items with handles, including casual luggage such as inexpensive plastic tote bags, paper shopping bags and wire baskets, and more particularly it relates to an accessory re-usable handle-sheath that is easily added over the handles of one or more existing tote bags or shopping bags to distribute the weight more comfortably, to provide hand protection and comfort with a heavy load.

BACKGROUND OF THE INVENTION

Inexpensive tote bags of various types are commonplace: two main categories are (1) soft plastic bags with a pair of cutout areas near the top forming two loops from the plastic bag material itself to serve as bag handles for hand carrying, and (2) paper shopping bags with an attached pair of carrying handles typically made from some form of cord having a diameter about ⅛ inch or less. Such minimal handle provisions are adequate for only light loads and short periods of time: if heavily loaded such handles quickly become unacceptably uncomfortable to the hand due to the very high p.s.i pressures concentrated on a very small area of the hand. They often leave skin impressions and marks which are painful, annoying and potentially harmful even if not permanent. Since such bags are generally regarded as throwaway items, cost constraints preclude providing the bags originally with handles of any higher quality. Thus there is an unfulfilled need for an inexpensive add-on handle-sheath that can be easily attached onto and detached from handles of tote bags, wire baskets, coat hangers, etc., and that can be re-used indefinitely.

DISCUSSION OF RELATED KNOWN ART

U.S. Pat. No. 4,902,060 to Nobackht, U.S. Pat. No. 4,890,355 to Schulten, U.S. Pat. No. 4,936,619 to Salazar, U.S. Pat. No. 4,923,235 to Stewart, U.S. Pat. No. 4,982,989 to Sweeny and U.S. Pat. No. 5,029,926 to Dieterich Jr., show detachable handles but they teach structure having particular three-dimensional features such as end enclosures and/or articulated conformal finger grips that preclude manufacture by extrusion.

U.S. Pat. No. 5,356,190 to Torres discloses a plastic bag handguard formed from a flat sheet of plastic and which, relying on a biased keeper flap, is not readily manufactured by extrusion.

OBJECTS OF THE INVENTION

It is a primary object of the present invention to provide an inexpensive add-on plastic handle-sheath that can be easily added over handle portions originally provided on a tote bag such as a paper or plastic shopping bag so as to distribute the weight over a much larger portion of a user's hand for added comfort and protection when carrying a heavy load in the bag, and that can be manufactured economically as a continuous extrusion, cut off in individual lengths.

It is a further object to provide an add-on handle-sheath that is easy to deploy onto a pair of handles of a tote bag and which, once in place and in an unstressed condition, retains the bag handles substantially captivated.

It is a further object that the add-on handle-sheath be readily detachable from the bag handles utilizing the flexibility of the plastic structural material.

It is a further object to make the add-on handle-sheath capable of frequent re-use.

It is a further object that the add-on handle-sheath be made such that it tends to become more firmly secured to the bag handles when seized in the grip of a user's hand.

It is a further object to provide an add-on handle-sheath embodiment of the invention suited to a pair of solid round handles, such as wire handles of a shopping basket, with provision to clip temporarily onto one of the handles and to clip more permanently onto the other.

SUMMARY OF THE INVENTION

The foregoing objects have been met in the present invention by an inexpensive extruded add-on handle-sheath of flexible plastic having a transverse cross-sectional shape defining an upwardly-facing V-shaped entry channel with pair of guidewalls converging downwardly to a narrowed throat leading to a wider conduit region in a bottom portion of the add-on handle for holding a pair of bag handles. The add-on handle-sheath is easily fitted to a tote bag by directing the two bag handles downwardly in the entry channel, through the throat and into the conduit region, where they become effectively but removably captivated in the add-on handle-sheath. Disclosed are a number of alternative extrudable cross-sectional configurations in which the present invention can be made and practiced.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
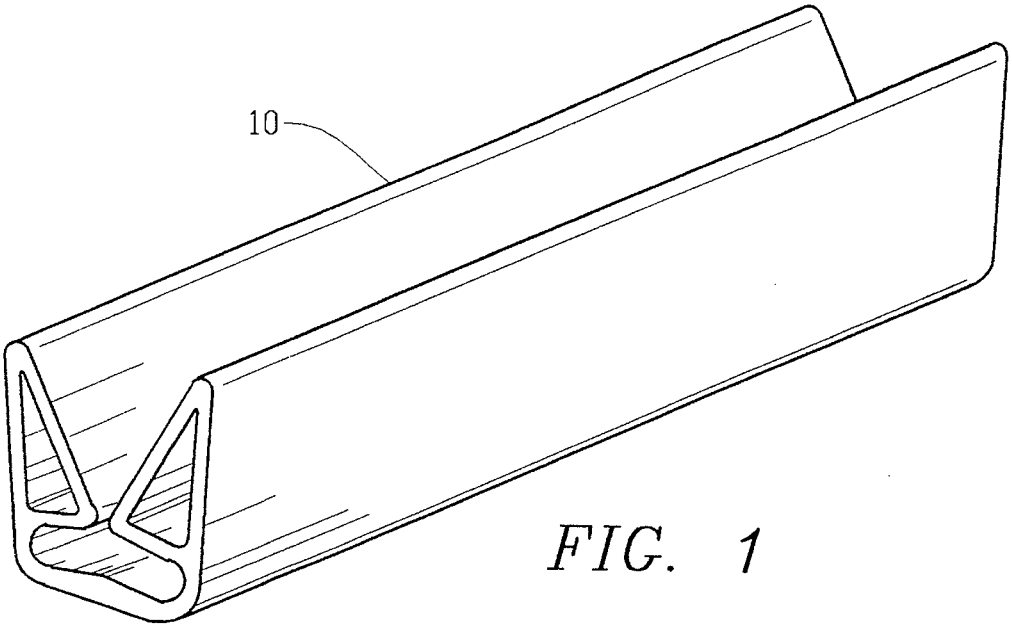
FIG. 1 is a perspective view of an add-on handle in a preferred embodiment of the present invention.

FIG. 1 is a perspective view of an add-on handle-sheath 10 configured in a preferred embodiment of the present invention. It may be manufactured economically from flexible plastic in an extrusion process wherein the continuously extruded material is cut off in individual equal lengths, typically predetermined in a range of about 4 or 5 inches for comfortable hand usage.

Figure 2:
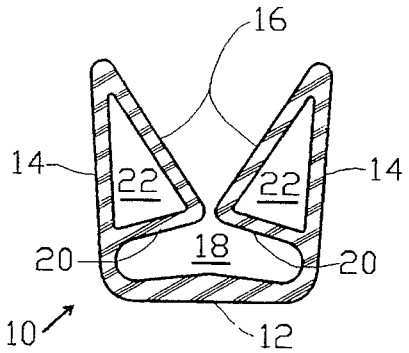
FIG. 2 is a cross-section of the handle of FIG. 1 in a normal unstressed condition.

FIG. 2 is a cross-sectional view of add-on handle-sheath 10 of FIG. 1 in a normal unstressed condition. Handle-sheath 10 is seen to form a generally U-shaped channel with a floor 12 and a pair of outer sidewalls 14 attached at the top to a pair of guidewalls 16 forming a generally V-shaped upwardly-facing guide channel that converges downwardly to a narrow throat leading to a wider main conduit 18 bounded by a pair of ceilings 20, lower portions of sidewalls 14, and floor 12. Void regions 22, configured in each side so as to make the wall thickness substantially uniform throughout, are optional: they conserve plastic material and make the handle-sheath 10 lighter in weight and more flexible to arch slightly under load.

Figure 3:
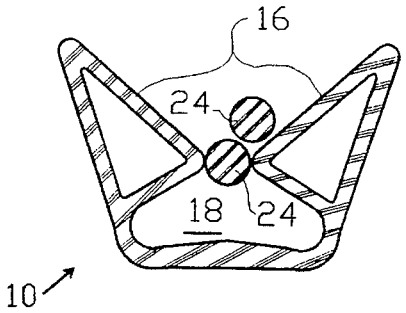
FIG. 3 is a cross-section of the handle of FIGS. 1 and 2 spread apart for insertion of two tote bag handles, shown in process of insertion.

FIG. 3 is a cross-section of the add-on handle-sheath 10 of FIGS. 1 and 2 showing the guidewalls 16 spread apart for insertion of two tote bag handles 24, shown in process of downwardly insertion into (or upwardly removal from) the bottom conduit 18. With regard to removal of bag handles 24, it is noted that the conduit ceiling surfaces 20 are sloped as shown (refer also to FIG. 2) to facilitate such removal, since pulling upwardly on the bag handle 24 for removal purposes tends to spread the the ceilings 20 apart and open up the throat as shown in FIG. 3, thus allowing bag handle removal as shown.

Figure 4:
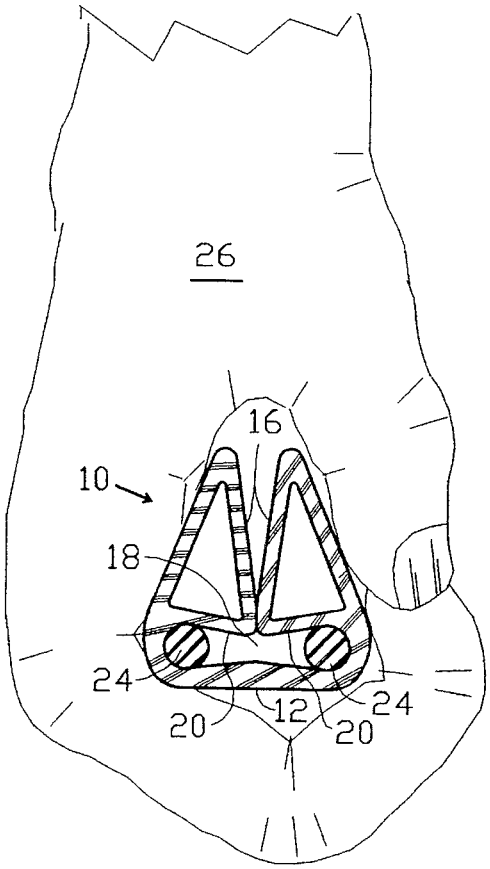
FIG. 4 is a cross-section of the handle of FIGS. 1–3, containing the handles of a tote bag in a carrying position, compressed in the grip of a hand of a person carrying the bag.

FIG. 4 is a cross-section of the add-on handle-sheath 10 of FIGS. 1–3, compressed in the grip of a human hand 26 and retaining the two bag handles 24 at opposite sides of the conduit region 18, in a mode typical of a person carrying a tote bag supported by attached bag handles 24. Compression from the grip of hand 26 squeezes the guidewalls 16 inwardly toward each other as shown, also the conduit ceilings 20 are now sloped down toward the center so as to close the throat, tending to captivate the bag handles 24 in place more tightly. The thickened central portion of floor 12 as shown also serves to direct the bag handles 22 to their respective intended opposite locations in conduit region 18.

Figure 5:
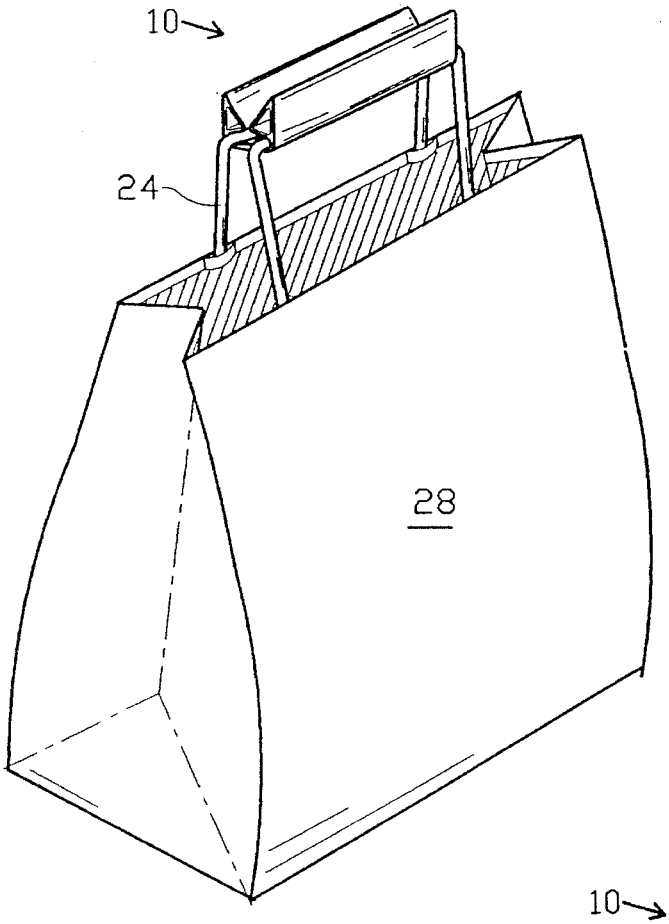
FIG. 5 is a perspective view of a tote bag of the paper shopping bag type fitted with an add-on handle of the present invention.

FIG. 5 is a perspective view of a tote bag 28 of the paper shopping bag type having cord-type bag handles 24, by which the shopping bag 28 can be fitted with a handle-sheath 10 of the present invention as depicted in FIGS. 1–4.

Figure 6:
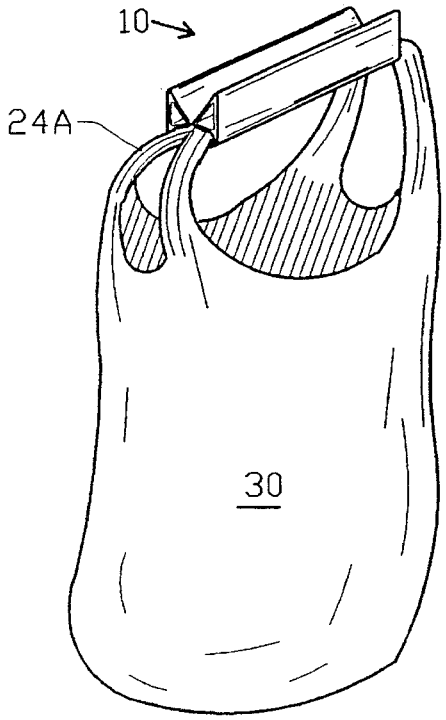
FIG. 6 is a perspective view of a tote bag of the soft plastic type, fitted with an add-on handle of the present invention.

FIG. 6 is a perspective view of a tote bag 30 of the soft plastic type having two openings forming bag handles 24A which when bundled together form a pair of generally round bag handles (equivalent to handles 24 in FIG. 5) by which the plastic bag 30 can be fitted with an add-on handle-sheath 10 of the present invention as depicted in FIGS. 1–4.

FIGS. 7A–7I show nine different cross-sections representing examples of a larger number of possible alternative forms in which the present invention may be practiced and which may be manufactured from selected plastic material in an extrusion process. These are shown in normal unstressed condition, comparable to FIG. 2.

Figure 7A:
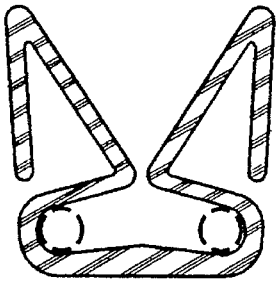
FIGS. 7A–7O show cross-sections of alternative forms in which the present invention may be practiced.
Figure 7B:
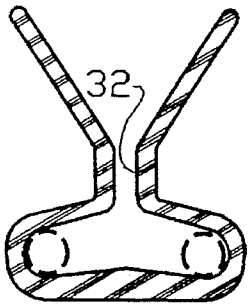
Figure 7C:
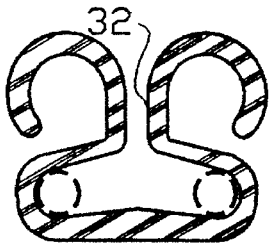
Figure 7D:
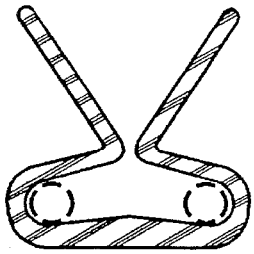

FIGS. 7A and 7C are two examples of a number of different possible ways in which the upper edges may be rolled over.

Figure 7E:
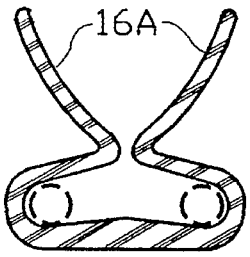
Figure 7F:
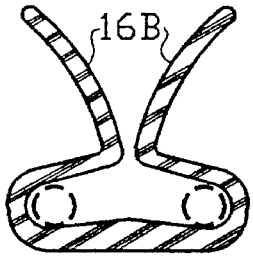

FIGS. 7B–C illustrate a parallel throat portion 32 which could also be applied to other forms, e.g. to FIGS. 7A, 7E and 7F.

FIG. 7E shows concave guidewalls 16A and FIG. 7F shows convex guidewalls 16B as alternatives to flat guidewalls 16 as shown in FIGS. 2, 7A, 7B and 7D: any of these three guidewall shapes could be utilized interchangeably in conjunction with other cross-sectional variations.

Figure 7G:
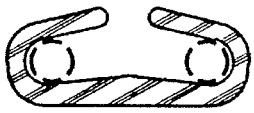

FIG. 7G is a simplified configuration that sacrifices effectiveness of captivation for easier attachment and detachment from tote bag handles, and is also suitable for round rigid handles such as wire handles of shopping baskets.

Figure 7H:
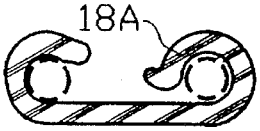

FIG. 7H is derived from FIG. 7G by shaping one of the conduit regions 18A to snap-on and captivate one of the two handles: this is convenient for wire handles of shopping baskets. For this purpose the handle-sheath can be made of semi-rigid plastic material or metal, and the snap-on side 18A can be made to attach in a permanent manner or in a manner that makes removal difficult: in either case it is typically dimensioned to rotate freely on the wire handle.

Figure 7I:
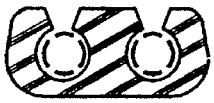

The embodiment shown in FIG. 7I provides two separate entrance channels and corresponding round conduit regions for bag handles or wire basket handles. This configuration can also made to have more than two similar entrance channels.

In the forms in FIGS. 7A–7G, the floor portion shown formed with a thickened central region, could also be formed with uniform thickness in the floor section. In that event, the forms in FIGS. 7A–7H could be formed with uniform material thickness throughout, and thus could be thermally formed from sheet plastic, as an alternative to extrusion.

The floor surface can be made planar, centrally raised, centrally lowered or can be made to have articulated parallel grooves to accommodate any number of handles.

Figure 7J:
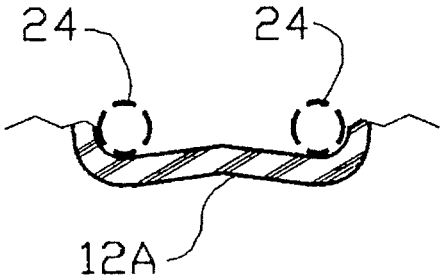
Figure 7K:
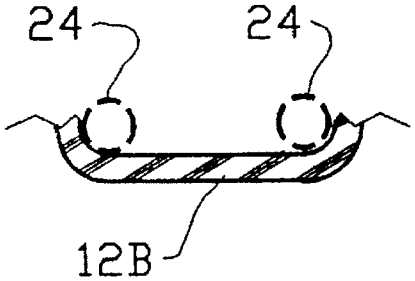
Figure 7L:
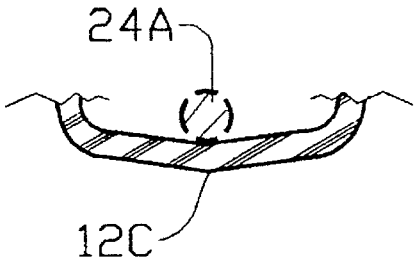

FIGS. 7J–M depict cross-sections of alternative floor configurations, any one of which may be used along with one of the upper portions shown in FIGS. 1–7 and 7O. Floors in FIGS. 7JL have uniform cross-sectional thickness: FIG. 7J shows floor 12A with a raised central region, FIG. 7K shows floor 12B substantially flat, and FIG. 7L shows floor 12C with a lowered central region, suitable for use with a single wire handle 24A as shown, for example that of a paint can.

Figure 7M:
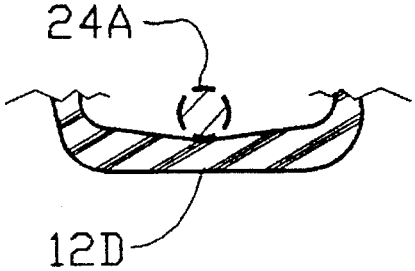

FIG. 7M shows a floor portion 12D wherein the floor surface is made to have a lowered central region, as in FIG. 7L, while the bottom surface is made to be substantially flat, thus the thickness increases toward the edges.

Figure 7N:
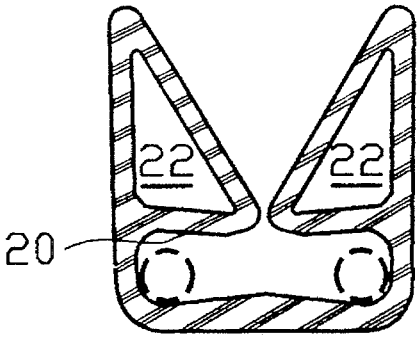
Figure 70:
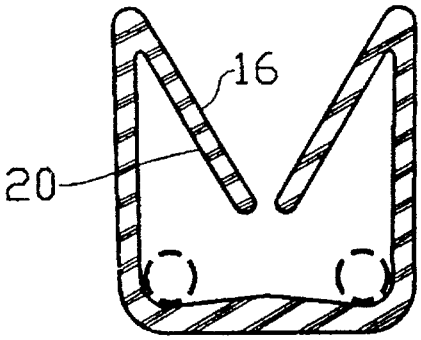

FIGS. 7N and 7O show cross-sectional handle-sheath shapes wherein the conduit ceilings 20 slope upwardly from the central throat region: FIG. 7N is a modified version of FIG. 2, with a pair of cell regions 22 formed in the extruding process, while in FIG. 7O there are no cell regions, ceiling 20 being formed by the underside of guidewalls 16. The configuration of FIG. 7O is low in cost, and is appropriate where ease of removal is not important.

A flexible embodiment of the invention can be curved and dimensioned to fit a curved wire handle such as on a coat hanger.

The handle-sheath of this invention can be dimensioned to accommodate any predetermined number of handles of either metal or other material, and thus could enable the user to carry several bags with one handle-sheath.

The various embodiments of this invention may be formed from appropriate suitable materials such as plastic, metal or wood, and may be formed in other processes as well as extrusion and/or injection molding.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description;

and all variations, substitutions and changes which come within the meaning and range of equivalency of the claims are therefore intended to be embraced therein.

What is claimed is:

1. A handle-sheath, for deployment onto one or more existing handles of a carried item in the category of shopping bags, tote bags, wire baskets and coat hangers, for hand comfort when carrying heavy loads, comprising a predetermined length of flexible material made to have a uniform cross-sectional configuration such that said handle-sheath can be formed in an extrusion process, the cross-sectional configuration defining:

an upwardly-facing generally V-shaped entry channel formed by a pair of downwardly-converging guide surfaces;

a throat region at lower extremities of the guide surfaces and defining a predetermined minimum entry channel width;

a conduit region, disposed in a lower portion of said handle-sheath beneath said throat region and communicating therewith, extending outwardly symmetrically therefrom, bounded by a pair of opposed sidewall surfaces, a generally horizontal floor portion having an upwardly-facing floor surface extending between the sidewall surfaces and sloping downwardly from a raised central region to the opposed sidewall surfaces, and a pair of ceiling surfaces each extending from said throat region to corresponding sidewall surfaces, said conduit region being made to have a pair of opposed side regions each dimensioned to accommodate one handle;

whereby said handle-sheath may be deployed for carrying the item by inserting one or more handles, via said entry channel through said throat region into the corresponding conduit side regions;

said throat region being dimensioned to make the minimum entry channel width, under an unstressed material condition, smaller than a designated nominal handle diameter;

whereby each inserted handle, under the unstressed material condition, is caused to be retained substantially captivated in said conduit region, the handle having been initially inserted thereinto by flexing said handle-sheath in a manner to separate the guide surfaces sufficiently to allow entry of the handle.

2. The handle-sheath as defined in claim 1 wherein the cross-sectional configuration further defines a pair of approximately vertical outer sidewalls extending from upper edges of said guide surfaces to two opposite edges of the floor.

3. The handle-sheath as defined in claim 2 wherein the cross-sectional configuration further defines:

the two ceiling surfaces sloping downwardly from said throat region to corresponding sidewall surfaces; and said guide surfaces being planar.

4. The handle-sheath as defined in claim 1 wherein the cross-sectional configuration further defines the two ceiling surfaces sloping upwardly from said throat region to corresponding sidewall surfaces.

5. The handle-sheath as defined in claim 1 wherein the cross-sectional configuration further defines the two ceiling surfaces sloping downwardly from said throat region to corresponding sidewall surfaces.

6. The handle-sheath as defined in claim 1 wherein the cross-sectional configuration further defines said guide surfaces as being planar.

7. The handle-sheath as defined in claim 1 wherein the cross-sectional configuration further defines said guide surfaces as being curved in a convex shape in the entry channel.

8. The handle-sheath as defined in claim 1 wherein the cross-sectional configuration further defines said guide surfaces as being curved in a concave shape in the entry channel.

* * * * *